United States Patent [19]

Schumann et al.

[11] Patent Number: 4,850,520

[45] Date of Patent: Jul. 25, 1989

[54] CYLINDRICAL STITCHING DEVICE FOR BINDING SINGLE SHEETS

[75] Inventors: Frank Schumann, Machern; Claus-Dieter Redmer; Lutz Richter, both of Leipzig, all of German Democratic Rep.

[73] Assignee: VEB Kombinat Polygraph "Werner Lamberz" Leipzig, Leipzig, German Democratic Rep.

[21] Appl. No.: 162,435

[22] Filed: Mar. 1, 1988

[30] Foreign Application Priority Data

May 4, 1987 [DD] German Democratic Rep. ... 302357

[51] Int. Cl.[4] ..... B27F 7/10

[52] U.S. Cl. ..... 227/81; 227/99

[58] Field of Search ..... 227/81, 99; 112/121.14, 112/322, 318, 256, 304

[56] References Cited

U.S. PATENT DOCUMENTS

| | | | |
|---|---|---|---|
| 3,060,443 | 10/1962 | Monroe et al. | 227/81 |
| 3,762,622 | 10/1973 | Noren | 227/81 |
| 4,196,835 | 4/1980 | Schlough | 227/81 |
| 3,653,5704 | 4/1972 | Alsop | 227/81 |

*Primary Examiner*—Frank T. Yost
*Assistant Examiner*—James L. Wolfe
*Attorney, Agent, or Firm*—Jordan and Hamburg

[57] ABSTRACT

A cylinder stitching device for binding single sheets for thread sealing, modified French sewing, as well as for wire stitching, includes a stitching cylinder that is controlled by central cams. The stitching cylinder is equipped with stitching heads which can be automatically lubricated, are adjustable, and can optionally be replaced. The production arrangement, attached peripherally to the circumference of the stitching cylinder, is likewise replaceable and automated, so that, by use of the adjusting devices provided for the cylinder stitching device, rapid adaptation to changing processing material as well as high productivity are guaranteed.

11 Claims, 6 Drawing Sheets

CYLINDRICAL STITCHING DEVICE FOR BINDING SINGLE SHEETS

Figure 1:
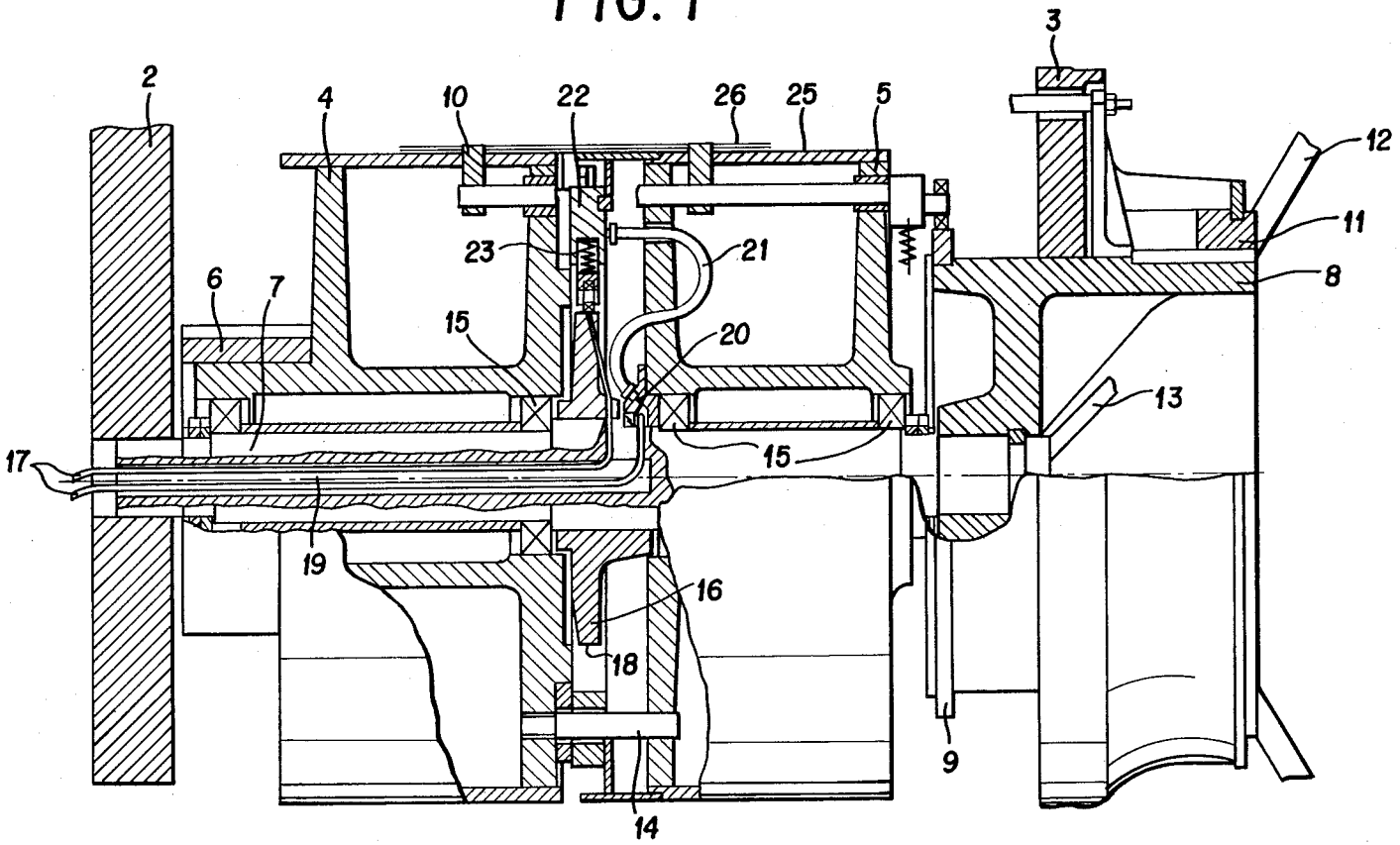

A cylindrical stitching device for binding single sheets is used for binding single sheets by means of various technologies. It is intended to be used in conjunction with high-speed web-fed rotary printing and folding machines to fabricate single-layer and multilayer products.

BACKGROUND OF THE INVENTION

DD-PS No. 75.277 discloses a method and a device for the thread-stitching of folded sheets, so that the folded sheets can be stitched in conjunction with web-fed rotary stitching machines. In this reference the folded sheets are continuously moved on a stitiching cylinder; at the same time, they are punctured along a defined section by stitiching needles operating at the same speed, while a stitching or sealing thread is being inserted. The ends of the thread are sealed or glued by passing fixed devices disposed along the circumference of the stitching cylinder.

The stitching cylinder has sheet gripping elements disposed on its jacket, whereby the stitching thread is pressed against the stitching material by means of controllable pressure elements. The stitching needles rotate with the stitching cylinder about a fixed control cam, which initiates the function of the stitching needles that are guided against it by means of pressure springs.

With the high productivity of modern web-fed rotary printing machines, high wear certainly occurs at the guides of the needle motion, and this cannot be compensated for by rapid disassembly of the latter. Furthermore, there is no opportunity to adapt to the expected product spectrum by optional different binding methods. Up to now, there has been no solution for lubrication.

DD-PS No. 138 525 discloses equipment for the puncturing of thread clamps; this equipment likewise works with moving stitching material which are accompoanied by needle guides supported by an endless chain and by needles, that are guided in such a fashion, to insert the sealing thread. The motion of the needles is initiated by an electromagnet and by control cams. This solution has the disadvantage that complex working steps would be associated with the necessity of always replacing all the production elements at th circulating chain. Due to the complex action chain, an increase of production speed is also associated with greter proneness to problems with the equipment.

SUMMARY OF THE INVENTION

It is the object of the invention to achieve an increase of the techincal-economic efficiency of cylinder stitching by reducing the original costs and the necessary ste-up times.

The object that must be achieved for this purpose is to adapt the stitching equipment to optional changing process materials and methods and to create the technical preconditions for its trouble-free low-wear operation.

According to the invention, lubrication points are affixed at the stitching heads of the cylinder stitching device, these lubrication points being equipped with feedlines for the lubricant. The feedlines extend through the axis of the stitching device. The lubricant is applied preferably to the running path of the central control cam and to the moving stitching head elements. By pressurized application or due to the partial inclusion of the lubricant feedline in the stitching cylinder rotation and the use of centrifugal force, the lubricant is moved into its action area. Textile materials are provided for appropriately dosing the lubricant within the stitching head.

In order that the stitching cylinder can be moved laterally, its axle is connected with a spindle on the operator side. The thread of the spindle is screwed into that of a fixed nut that is equipped with handles. When the fixed nut is rotated, the stitching cylinder is correspondingly moved along its axle. The axle of the stitching cylinder furthermore is connected on one side to a hand wheel. When the hand wheel is activated, it causes the control cam, which is supported on the axle, to move along with it. This causes the stitching process to halt, since the control cam is positioned in an appropriately diffferent position with respect to the cylinder circumference.

Production elements, especially a glue wheel or a nozzle glue applicator, stitching and sealing bars, which can optionally be replaced, are positioned peripherally of the stiching cylinder. They are situated on a rocker that can be moved on the cylinder circumference laterally to the sealing line. This rocker has an electromagnet on one side, by means of which the production means can be pivoted at the stitching cylinder circumference as needed. In their angled position, the heat supply to the process material and the cylinder is interrruped, and rapid maintenance and replacement of these parts of the stitching equipment becomes possible.

The stitching thread which is used during stitching is guided on the sthitching cylinder in a continuous or interrupted groove. For this purpose the groove for the stitching thread is formed by the cover plate of the stitching head and a movable thread clamping element that is held in its position by the force of a spring. If the groove is interrupted, the thread nozzle which feeds in the thread should be lifted off in correspondence with the with the sequence of cover plates, preferably by means of a cam, or it should be lowered between the clamping element and the cover plate. Inasmuch as the thread must be held in its position as required by the working step, a fixed roller bearing is attached, which is passed by the clamping element when the stitching cylinder rotates, and is thus moved counter to the spring force. As a result, the groove constructs to such an extent that the thread is clamped fast therein. At the same time, the thread clamping element is moved into the action range of an electromagnet, which holds it is its position counter to the spring froce. The holding force can be applied variably depending on position. These technical preconditions assure safe handling of the stitching thread even at higher working speeds. When the cylinder stitching equipment is used for wire stitching, a bending element is fixedly positioned at the stitching cylinder. This bending element is designed as a cylinder worm, whose screw has a clam-shaped cross section. Furthermore, the clamping element has a pin affixed to it, by means of which a cutting blade that is movably mounted on the cylinder circumference is guided against the wire, counter to a spring, and along a fixed blade, (shear-cutting principle), so that the wire being stitched is cut off. As the bending element continues to rotate, the wire clamp is formed in conjunction with the form elements that are integrated in the stitching head. A driver acts when the wire clamp subsequently punctures the paper. The wire clamp which has thus punctured the process material is closed at a defined point of the cylinder circumference by means of a counter cylinder. ,

BRIEF FIGURE DESCRIPTION

The following embodiments are to be elucitated by way of the following drawings. The figures show the following:

FIG. 1: The stitching cylinder in its operating position in a longitudinal section, with a stitching cylinder axle, a central cam, a lubricating device, an adjustment nut, a driving gear wheel, and a device for rotating its axle.

Figure 2:
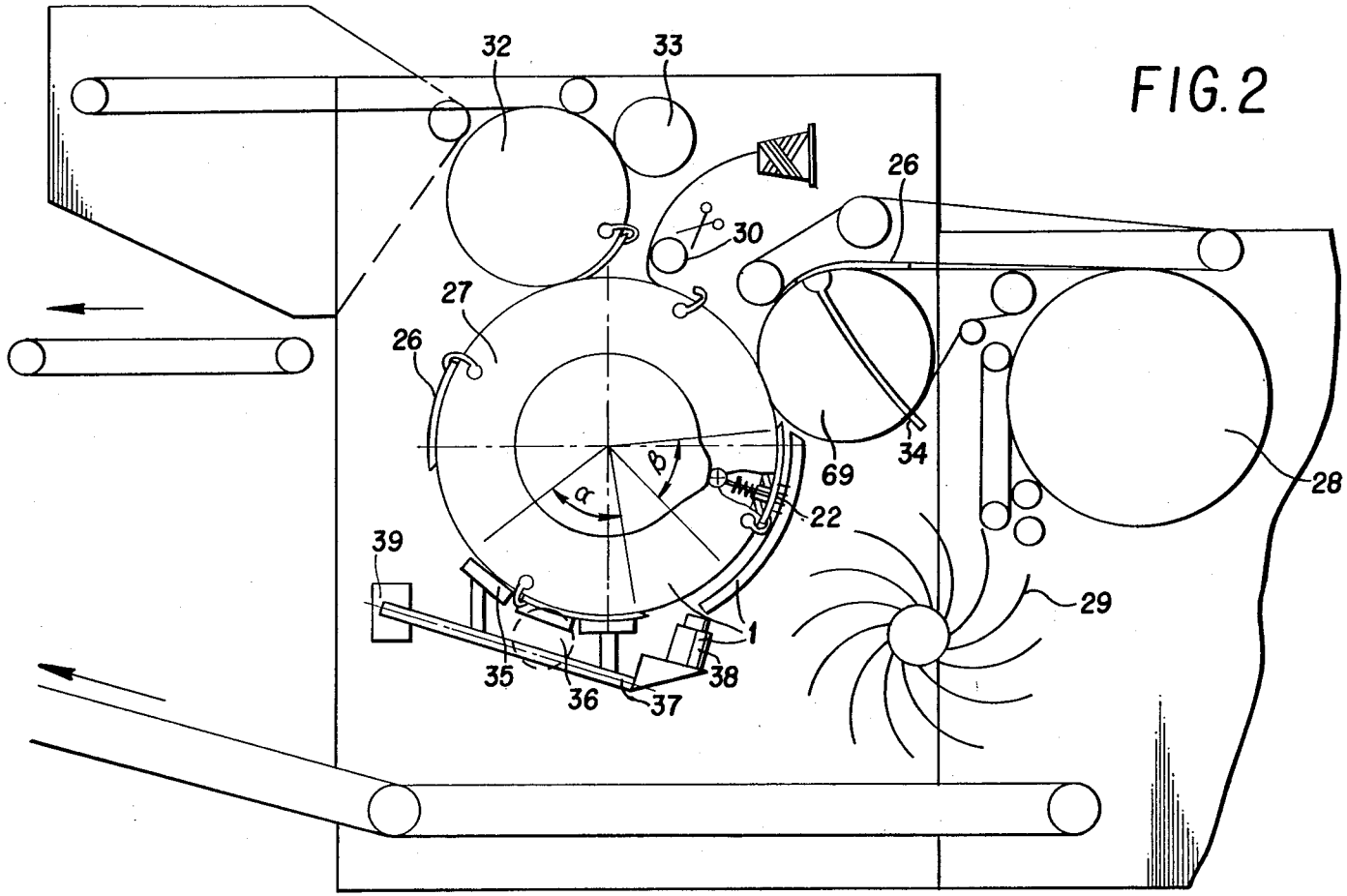

FIG. 2: A cylinder stitching device with equipment for sealing the thread or for French sewing.

Figures 3, 4, 5:
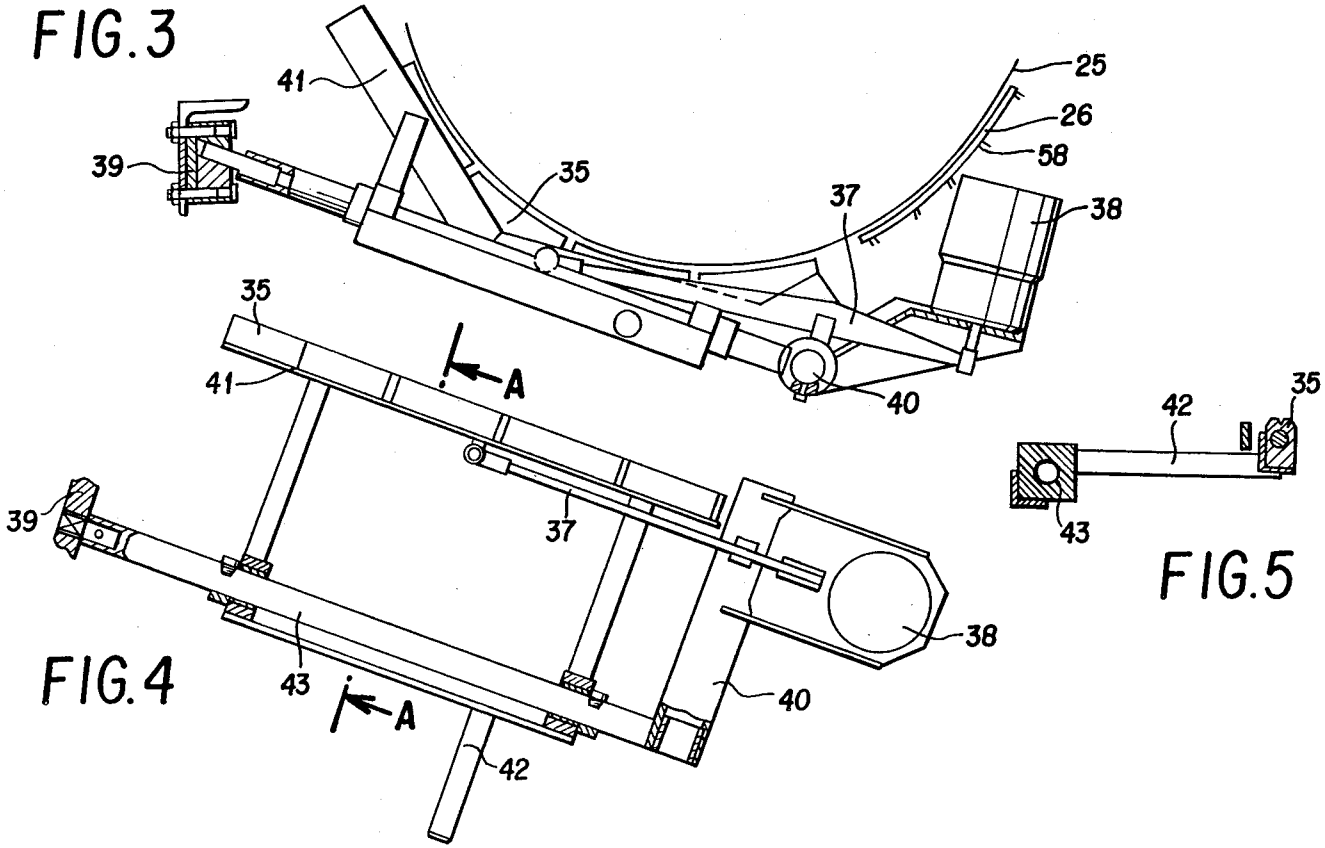

FIG. 3: The stitching cylinder circumference with an attached sealing bar, the crossbars, and the rocker that is moved by and electromagnet FIG. 4: A top view onto the sealing bar, the electromagnet, the rocker, and elements supported thereon.

FIG. 5: Section A—A through FIG. 4.

Figures 6, 7:
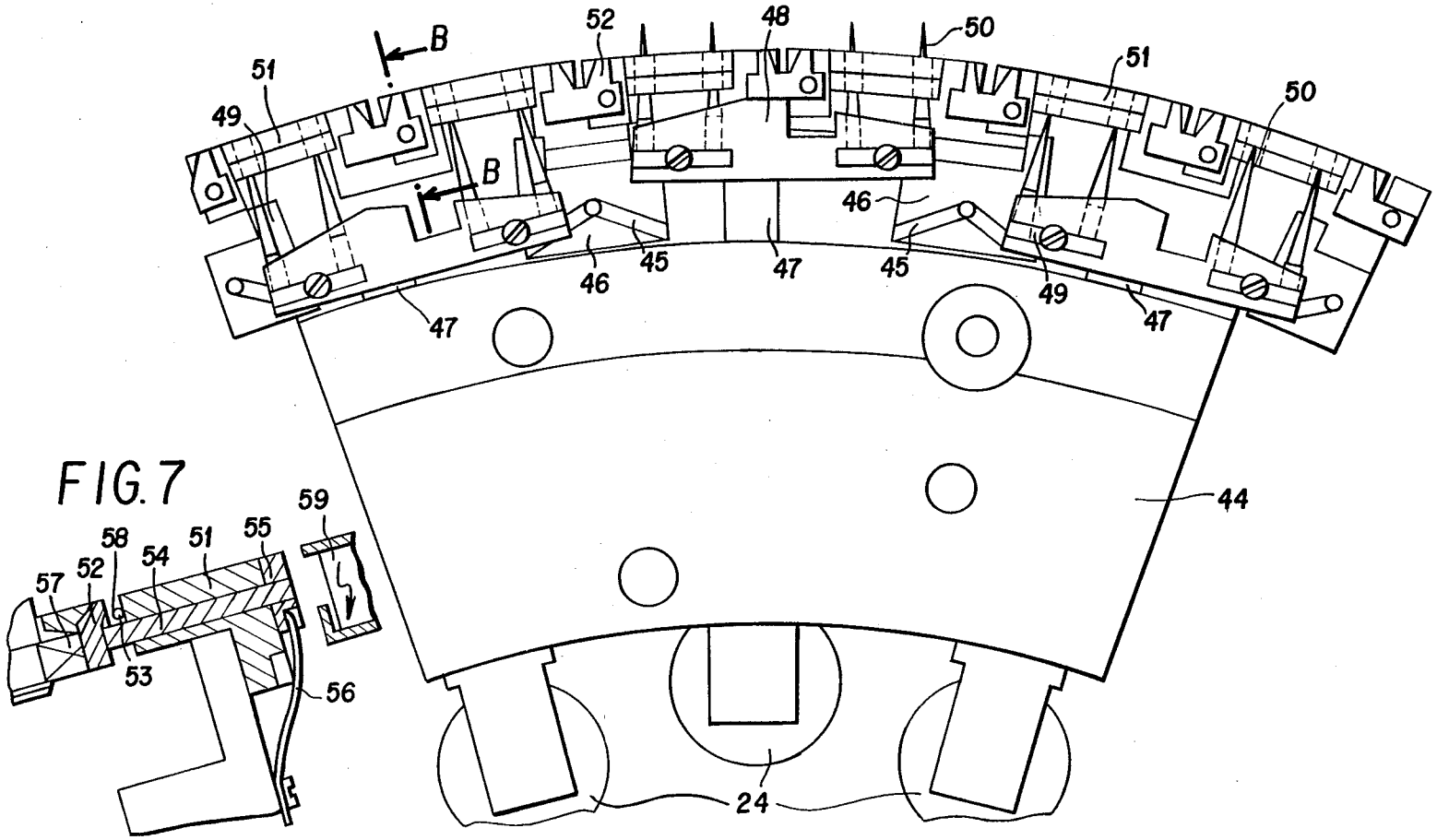

FIG. 6: A stitching head for thread stitching, French sewing, or thread sealing with roller bearings for the central cam scanning, a stitching head base body, the stitching needles that are held on tappets and needle supports, as well as elements for lubrication and for clamping the thread.

FIG. 7: Representation of the section B—B on FIG. 6, with roller bearing, thread clamping element, spring, and magnetic element.

Figure 8:
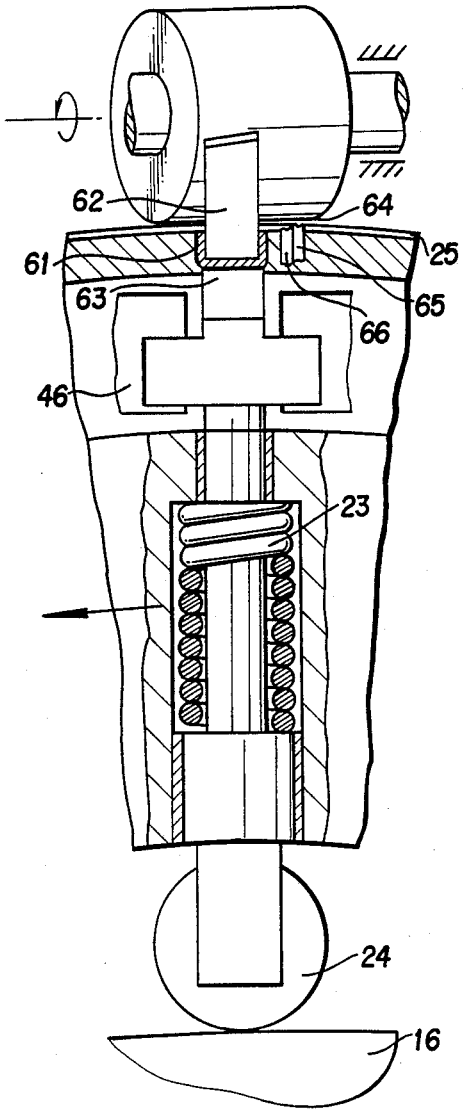

FIG. 8: This representation shows a section through a stitching head designed for wire stitching, which interacts with the rotating bending element that is attached at the stitching cylinder circumference.

Figure 9:
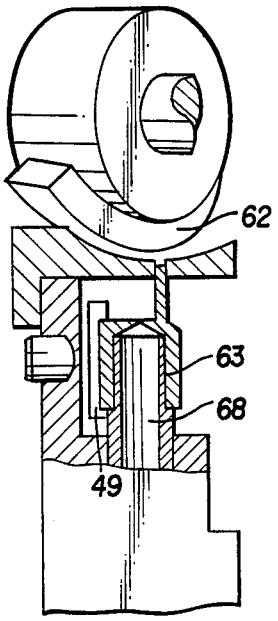

FIG. 9: A section through the stitching head for wire stitching with interacting bending element, driver and alignment elements.

Figure 10:
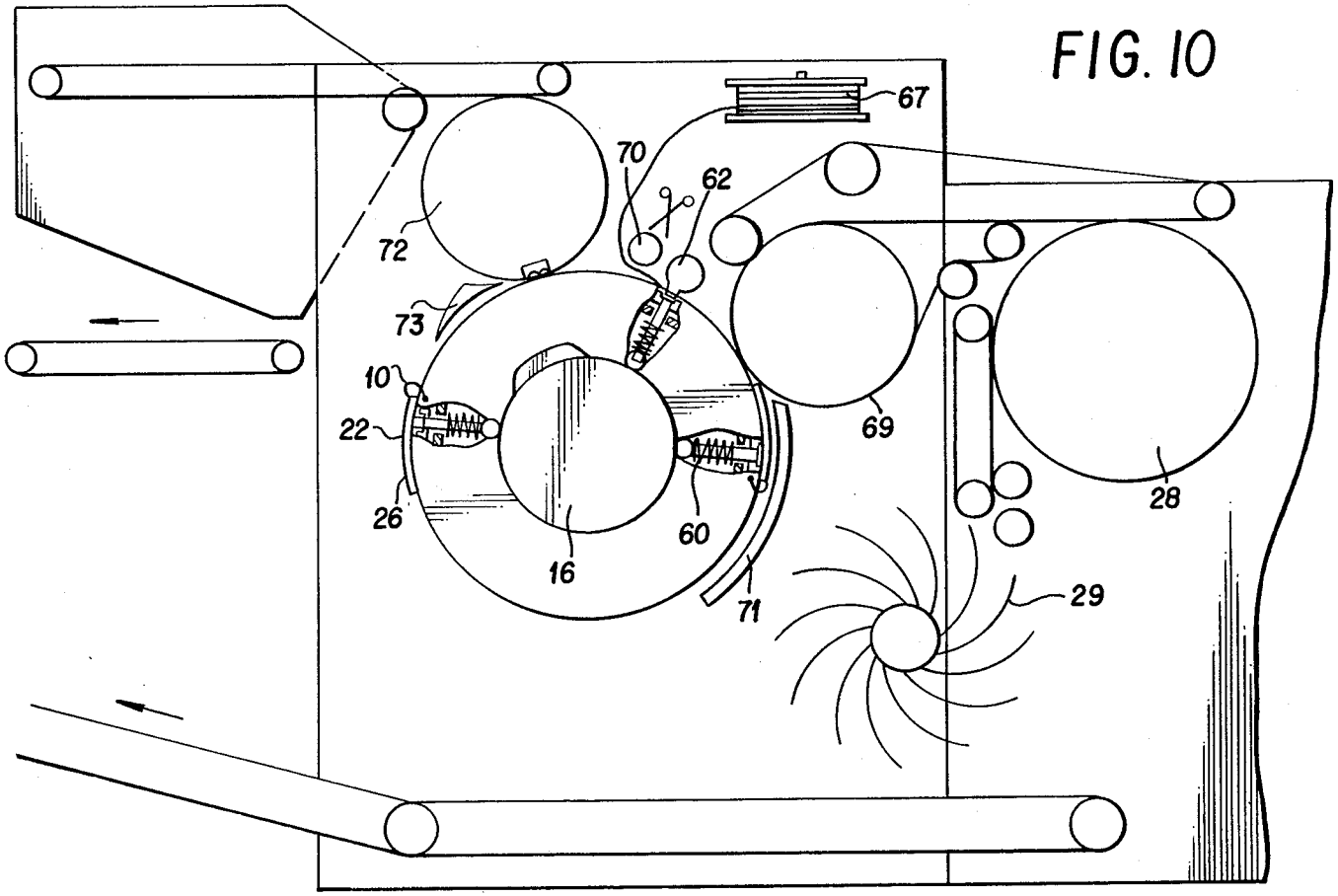

FIG. 10: A cylinder stitching device with production means for wire stitching is shown. What is emphasized in section are the stitching heads during the formation of the wire clamp, during the pricking of the wire clamp, and before the closing of the wire clamp by the counter cylinder.

DETAILED DISCLOSURE OF THE INVENTION

FIG. 1 shows the cylinder stitching device 1 in a longitudinal section with a rack wall 2 on the drive side and a rack wall 3 on the operator side. The left cylinder half 4 and the right cylinder half 5 are shown. The drive gear wheel 6 is connected to the left cylinder, half 4, indirectly to the right cylinder half 5. The cylinder halves 4 and 5 are mounted on the cylinde axle 7. The spindle 8 supports the control cam 9 for the sheet gripper 10, and it is connected to the fixed adjustment nut 11. The handles 12 are attached to the fixed adjusting nut 11. At the end of the stitching cylinder axle, on the operator side, handles 13 are affixed so that the axle can be rotated. FIG. 1 furthermore shows the driving pin 14 which connects the stitching cylinder halves 4, 5. The roller bearings 15 are provided for mounting the cylinder half 5 on the axle. The central cam 16 is mounted between the stitching cylinder halves 4, 5, in a defined position on the stitching cylinder axle 7. The central cam 16 is penetrated by the lubricant feed 17, which is guided through the stitching cylinder axle, and terminates on the running path 18 of the central cam 16. This results in a low-wear of the driving and control function of the cam.

Another lubricant feed 17 likewise extends through the bore 19 of the stiching cylinder axle 7. It empties into an oil distributor 20, from which the lubricant lines 21, which participate in the rotation of the stitching cylinder, lead to the individual stitching heads 22. The stitching heads 22 are movably positioned between the stitching cylinder halves 4, 5. By means of the roller bearing, wich is held by the pressure spring 23, they tap the control drive from the central cam 16, by means of which the stitching head 22 acts on the sheet 26, held on the stitching cylinder circumference 25.

FIG. 2 shows the cylinder stitching device 1 with production means for thread sealing or French sewing. The stitching cylinder 27 is surrounded by a folding flap cylinder 28, the emergency delivery unit 29, the thread head with a multi-cutting whell 30, and the transfer cylinder 32 with an attached perforating cylinder 33. The infed sheet 26 optionally runs through a glue feeder 34 which is disposed flush with the stitching line. The seized sheet 26 is then processed by the thread stitching heads 22 in the sector which is marked by the needle pricking angle $\beta$. For sealing in the sector of the sealing angle $\alpha$, the sealing bar 35 and the glue wheel 36 are optionally positioned on a rocker 37 which is attached in this section on the stitching cylinder. This rocker 37 has an electromagnet 38 on one side, so that it can be pivoted as needed.

FIG. 3 shows the periphery of the stitching cylinder 27 in the area of the sealing angle $\alpha$with the sheet 26, the stitching cylinder circumference 25, and the rocker 37 that is mounted in the crossbars 39, 40. The sealing bar 35 is situated on the rocker 37, and it is reinforced by the sealing bar holding device 41.

FIG. 4 shows a top view of the sealing device with the sealing bar 35, the sealing bar holding device 41, the rocker 37, the associated support elements 42, as well as the electromagnet 38, which is needed to pivot the rocker 37.

FIG. 5 shows the section A—A through FIG. 4, where the armature 43, the support elements 42, and the sealing bar 35 can be seen in cross section.

The roller bearing 24 for sensing the cams, the stitching head base body 44, as well as elements for stitching and lubrication are shown in FIG. 6. In particular, the figure shows the alignment plates 46, equipped with the lubricant channels 45, the tappets 47 with the needle supports 48 and their clamping elements 49 and the stitching needles 50. The lubricating channels 45 can be inlaid with textile materials if needed. During their cam-controlled motion, the stitching needles 50 penetrate the cover plate 51.

The function of the thread clamping device can be seen in FIG. 7. The thread clamping plate 52 presses the thread 53 above the tappet 54 against the cover plate 51, before cutting begins, until the needle puncture. The tappet 54 is connected to the holding plate 55, which is also acted upon by the spring 56. When the thread is cut, the roller bearing 57 first presses the thread clamping plate 52 with the spring 53 in the groove 58 against the cover plate 51. After cutting, the magnetic element 59, in contact-free fashion, causes the thread to be clamped via the holding plate 55.

FIG. 8 shows a section of the wire stitching head 60 when the wire clamp 61 is bent. The rotating bending element 62 is designed similar to a cylinder worm with a clam-shaped toothed cross section. The clamp design is obtained by interaction with the bending element 62 and the cover plate 51. The drive 63 is a component of the wire stitching head 60. The pin 64 of the bending element 62 moves the cutting blade 65, mounted at the cylinder circumference 25, against a spring force, along a fixed blade 66, so that the wire 67 for the wire clamp 61 is cut off. FIG. 8 furthermore shows the alignment elements 46 of the driver 63. These impart the necessary guidance to the driver 63, which is moved outwardly through the central cam 16. The pressure spring 23 is positioned at the tappet 68 of the driver 63. It presses the tappet 68 against the central cam 16.

FIG. 9 shows the bending element 62 with a sectional representation of the stitching head 60. The drive 63 is shown seated on the tappet 68 and guided by the alignment element 46.

FIG. 10 shows the cylinder stitching device with stitching heads 22 and with equipment for wire clamp stitching. The following are shown in particular: the folding flap cylinder 28, the emergency delivery unit 29, the sheet infeed 68, as well as the wire infeed and cutting device 70. The bending element 62, the counter bearing 71, and the counter cylinder 72 are identified in interaction with the stitching head 60. A guide plate 73 is attached to the stitching cylinder 27 before the counter cylinder 72.

We claim:

1. In a cylinder stitching device for binding single sheets, having sheet guiding means, and one or two mutually connected or adjacent cylinders that can rotate about one or more central cams fastened on the cylinder axle, the improvement comprising stitching head replaceably mounted to move along on the cylinder, said stitching heads being mounted for movement axially and also along the cylinder circumference with respect to the sheet guiding means, and further comprising devices, fixedly positioned peripherally of the cylinder circumference, for cutting and forming thread or wire and for gluing and sealing thread pieces on sheets to be stitched.

2. A cylinder stitching device according to claim 1, further comprising an axle rotating device for said cylinder that is equipped with handles.

3. A cylinder stitching device according to claim 1, further comprising means for manual axis displacement having an adjustment nut.

4. A cylinder stitching device according to claim 1 wherein the devices that are positioned peripherally to the stitching cylinder circumference are replaceable.

5. A cylinder stitching device according to claim 1 further comprising a rocker equipped on one side with an electromagnet and supporting heating elements for sealing the thread, as well as a glue basin together with a glue wheel.

6. A cylinder stitching device according to claim 1 further comprising a continuous or interrupted groove positioned between a thread clamping plate and a cover plate on the cylinder, and which is held in a selected position variably by a roller bearing counter to the action of a spring and by a magnetic element.

7. A cylinder stitching device according to claim 1 comprising wire stitching heads having a driver controlled by a central cam, and mounted to interact with a rotating bending element during formation of a wire clamp, said bending element being attached at a definite position to the stitching cylinder circumference, and comprising a cylinder worm with a clamp-shaped toothed cross section.

8. A cylinder stitching device according to claim 1 further comprising alignment plates equipped with lubricant channels, and movable fixed in the stitching head base body, said channels enabling lubricant to be fed in through an oil distributor in the stitching head base body, and to the base body through an oil distributor which utilizes centrifugal force, said distributor being adapted to rotate about the cylinder axle.

9. A cylinder stitching device according to claim 8, comprising textile materials that mounted in the lubricant channels.

10. A cylinder stitching device according to claim 1 comprising a sheet gluing device mounted flush to a stitching line on a sheet infeed device, for gluing the sheets before the thread clamps are inserted into the sheets to be stitched.

11. A cylinder stitching device according to claim 1 wherein the stitching cylinder further comprises means for folding sheets to be bound.

* * * * *